US005965227A

United States Patent [19]

Focke

[11] Patent Number: 5,965,227

[45] Date of Patent: Oct. 12, 1999

[54] CIGARETTE PACK AND MATERIAL WEB FOR THE PRODUCTION OF AN INNER WRAPPING FOR THIS

[75] Inventor: Heinz Focke, Verden, Germany

[73] Assignee: Focke & Co., Verden, Germany

[21] Appl. No.: 08/903,992

[22] Filed: Jul. 31, 1997

Related U.S. Application Data

[62] Division of application No. 08/313,385, Sep. 27, 1994.

[30] Foreign Application Priority Data

Sep. 30, 1993 [DE] Germany ..... 43 33 462

[51] Int. Cl.[6] ..... B65D 65/28

[52] U.S. Cl. ..... 428/43; 206/271; 206/273; 206/831; 229/87.05; 229/87.13; 428/192; 428/207; 428/211; 428/906

[58] Field of Search ..... 428/43, 192, 906, 428/201, 204, 203, 206, 207, 211; 229/87.05, 87.13; 206/271, 273, 831

[56] References Cited

U.S. PATENT DOCUMENTS

| | | | |
|---|---|---|---|
| 2,026,239 | 12/1935 | Luckett | 229/87.13 |
| 2,317,269 | 4/1943 | Hammarstrom | 229/125.02 |
| 3,083,820 | 4/1963 | Roberts | 206/264 |
| 3,096,878 | 7/1963 | Whitley et al. | 206/246 |
| 3,108,711 | 10/1963 | Anton | 221/92 |
| 3,752,308 | 8/1973 | Begemann | 206/256 |
| 4,949,841 | 8/1990 | Focke et al. | 206/254 |
| 5,137,148 | 8/1992 | Evers | 206/271 |
| 5,427,235 | 6/1995 | Powell | 229/87.13 |

FOREIGN PATENT DOCUMENTS

| | | | |
|---|---|---|---|
| 203503 | 12/1986 | European Pat. Off. . | |
| 556628 | 8/1993 | European Pat. Off. . | |
| 589289 | 3/1994 | European Pat. Off. . | |
| 1142546 | 1/1963 | Germany . | |
| 1980644 | 11/1967 | Germany . | |
| 2554731 | 6/1977 | Germany | 229/87.13 |
| 8321150 | 12/1983 | Germany . | |
| 3326457 | 2/1985 | Germany . | |
| 9112727 | 1/1992 | Germany . | |
| 9303703 | 7/1993 | Germany . | |

*Primary Examiner*—Nasser Ahmad
*Attorney, Agent, or Firm*—Sughrue, Mion, Zinn, Macpeak & Seas, PLLC

[57] ABSTRACT

Cigarette packs, namely hinge-lid packs and soft-cup packs in particular, are designed in such a way that the pack content, namely a cigarette group, is surrounded on all sides by an inner wrapping (11) consisting of paper with a decorative print applied on the outside. For reasons of cost above all, the print is applied only on those surface regions of the inner wrapping (11) which are exposed when the pack (hinge-lid pack) is open or by virtue of construction. The inner wrapping (11) is produced by being severed from a paper web which, depending on the design of the inner wrapping and depending on the folding construction, has printed zones (34, 35), arranged at a distance from one another, or a continuous strip-shaped printed zone (43, 51) located along the edge of the web.

5 Claims, 9 Drawing Sheets

CIGARETTE PACK AND MATERIAL WEB FOR THE PRODUCTION OF AN INNER WRAPPING FOR THIS

This is a divisional of application Ser. No. 08/313,385 filed Sep. 27, 1994.

BACKGROUND OF THE INVENTION

The invention relates to a cigarette pack with a box made from cardboard or with a cup made from paper and with an inner wrapping for the cigarettes which is made from paper or similar material and which has a print on the outside.

Cigarette packs are conventionally constructed by completely surrounding the pack contents, namely a cigarette group, by an inner wrapping. This has hitherto consisted predominantly of a tinfoil blank. Nowadays, inner wrappings made from paper are increasingly being used for ecological reasons. The blank for the inner wrapping is provided on the outside with a print. This can be an ornamental decoration. However, closely placed letterings covering the surface completely are also applied. The print is necessary in order to avoid the visually unattractive appearance of unprinted (white) paper.

SUMMARY OF THE INVENTION

The object on which the invention is based is to improve a cigarette pack of the abovementioned type with regard to the design of the inner wrapping, to the effect that it can be produced even more cost-effectively. To achieve this object, the cigarette pack according to the invention is characterized in that only the regions of the inner wrapping which project out of the open box or out of the cup are provided with a print.

The predominant regions of the inner wrapping, which, even when the cigarette pack is open, are located within the latter, that is to say within the box or the cup, remain substantially free of print. The outward impression is, nevertheless, that the inner wrapping is provided completely with a decorative print.

This measure affords a saving which is considerable in terms of the total costs of the packs. Furthermore, a further ecological benefit is also achieved in that the paper, as inner wrapping, is predominantly free of printing ink.

The invention can be used especially in cigarette packs of the hinge-lid type and of the soft-cup type. The inner wrapping is provided with a print in the region of selected surfaces. Edge surfaces of the blanks are printed according to the pack type, on the one hand, and to the principle of folding the inner wrapping, on the other hand. The printing surfaces are selected so that they are covered, with a sufficient excess length, by walls of the box or of the cup. As regards hinge-lid packs, the inner wrapping of which conventionally has, in the region of the front wall, a pull-off flap limited by a perforation line or the like, the printed surface extends at least as far as the perforation line, at best slightly beyond this. If the cigarette pack is put to use by pulling off the flap, the latter is printed over its entire surface.

Further features of the invention relate to the design of the blanks for the inner wrapping and to continuous material webs of paper or the like for the production of blanks for the inner wrapping. According to the invention, depending on the principle of folding of the inner wrapping, edge strips on one side or on both sides are provided with a continuous print, that is to say a printed strip. Alternatively, printed surfaces made at distances from one another can be formed within the material web. Within the latter, the severing cut for forming the blanks is then guided in such a way that exposed regions of the inner wrapping have a print.

Further particulars of the invention are explained in more detail below by means of exemplary embodiments. In the drawing:

DESCRIPTION OF PREFERRED EMBODIMENTS

Figure 7:
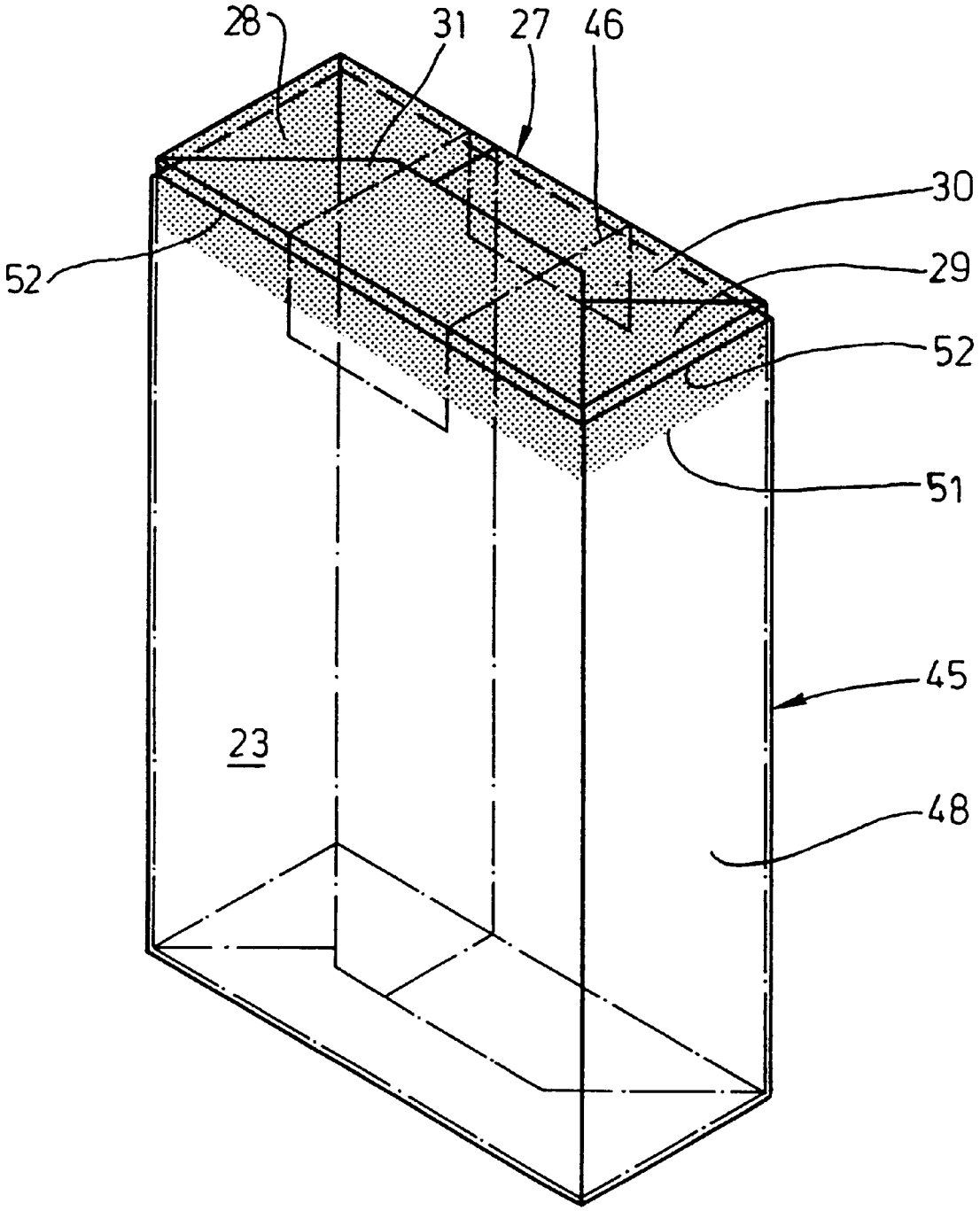
FIG. 7 shows a soft-cup pack in a perspective representation.

The new design for cigarette packs or for an inner wrapping of a cigarette group can be used especially advantageously for hinge-lid packs (FIG. 1 and FIG. 4) and for soft-cup packs (FIG. 7).

Hinge-lid packs conventionally consist of thin cardboard. A box part 10 serves for receiving the pack content, namely a cigarette group (not shown), which is surrounded on all sides by a folded inner wrapping 11 made from paper or paper-like material. A lid 12 is articulated on a rear wall of the box part 10, namely connected pivotably via a folding line acting as a hinge. Seated within the box part 10 is a collar 13 which, here, consists of a separate blank, likewise made from cardboard. The collar 13 extends with a collar front wall 15 in the region of a box front wall 14. Collar side tabs 16 extend in the region of box side walls 17. The collar 13 projects with a part region out of the box part 10 at the top. When the hinge-lid pack is in the closed position, this exposed part of the collar 13 is surrounded by the lid 12.

The collar front wall 15 has, in the free part projecting out of the box part 10, a recess or depression with a contoured collar edge 18. Below this collar edge 18, a top edge 19 extends as an upper limitation of the box front wall 14. This top edge 19 is continued, in the region of the box side walls 17, as a side edge 20 directed obliquely upwards.

The cigarette group as the pack content is surrounded on all sides by an inner wrapping designed in a special way. The unit thus obtained as the pack content is a cigarette block 21.

Figure 1:
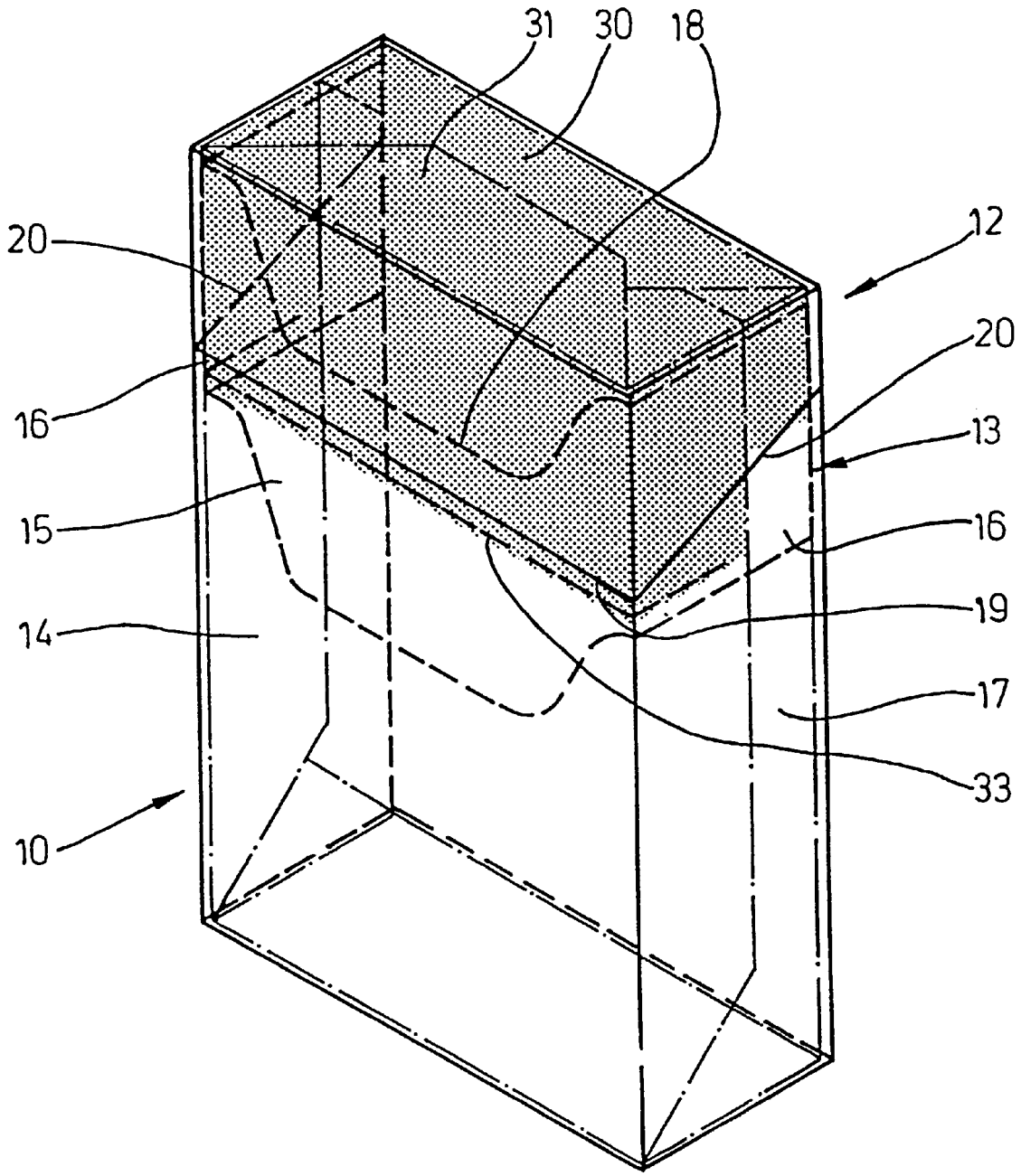
FIG. 1 shows a cigarette pack of the hinge-lid type in a perspective representation.
Figure 2:
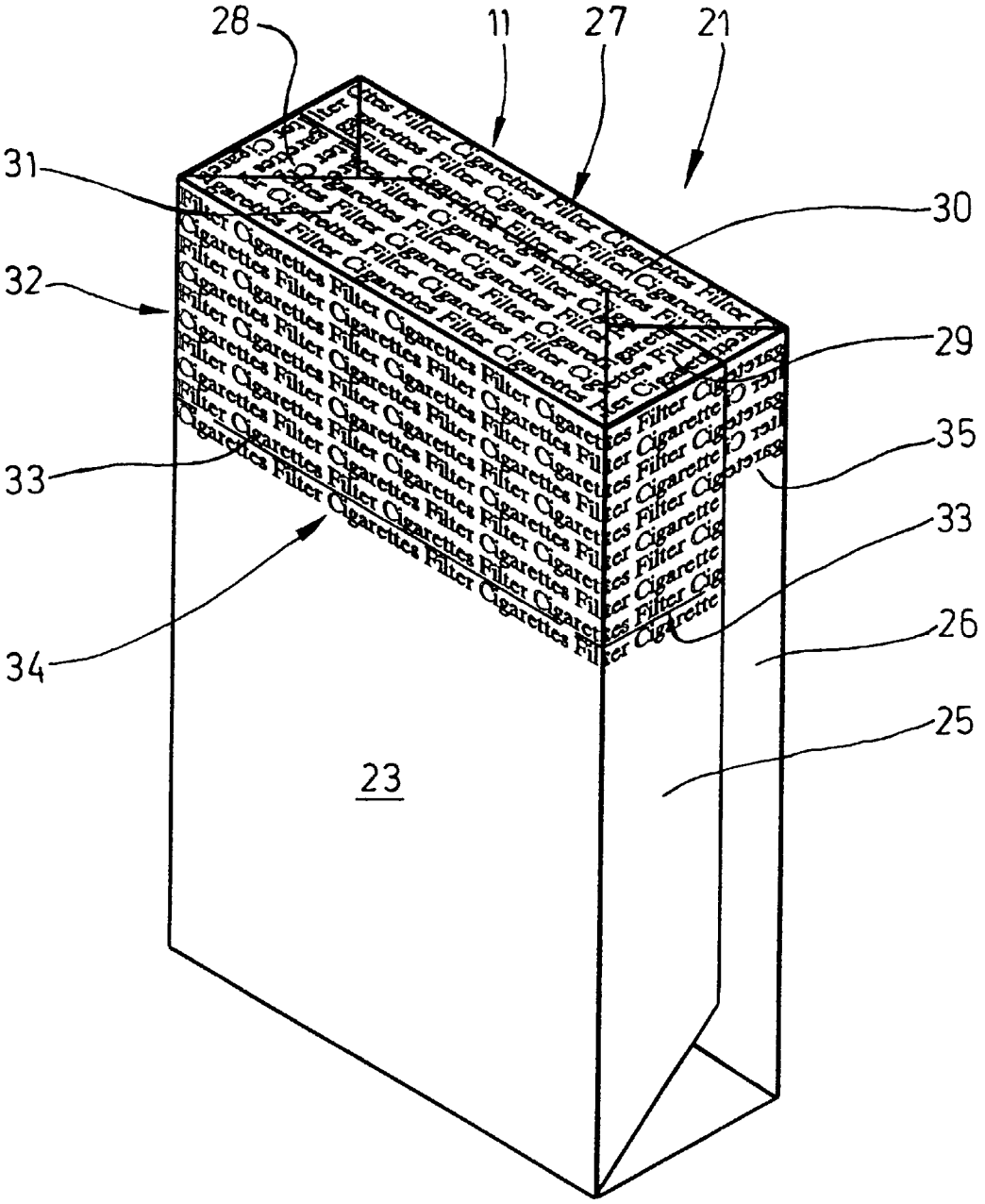
FIG. 2 shows a cigarette block, namely a group of cigarettes with an inner wrapping, likewise in a perspective representation.
Figure 3:
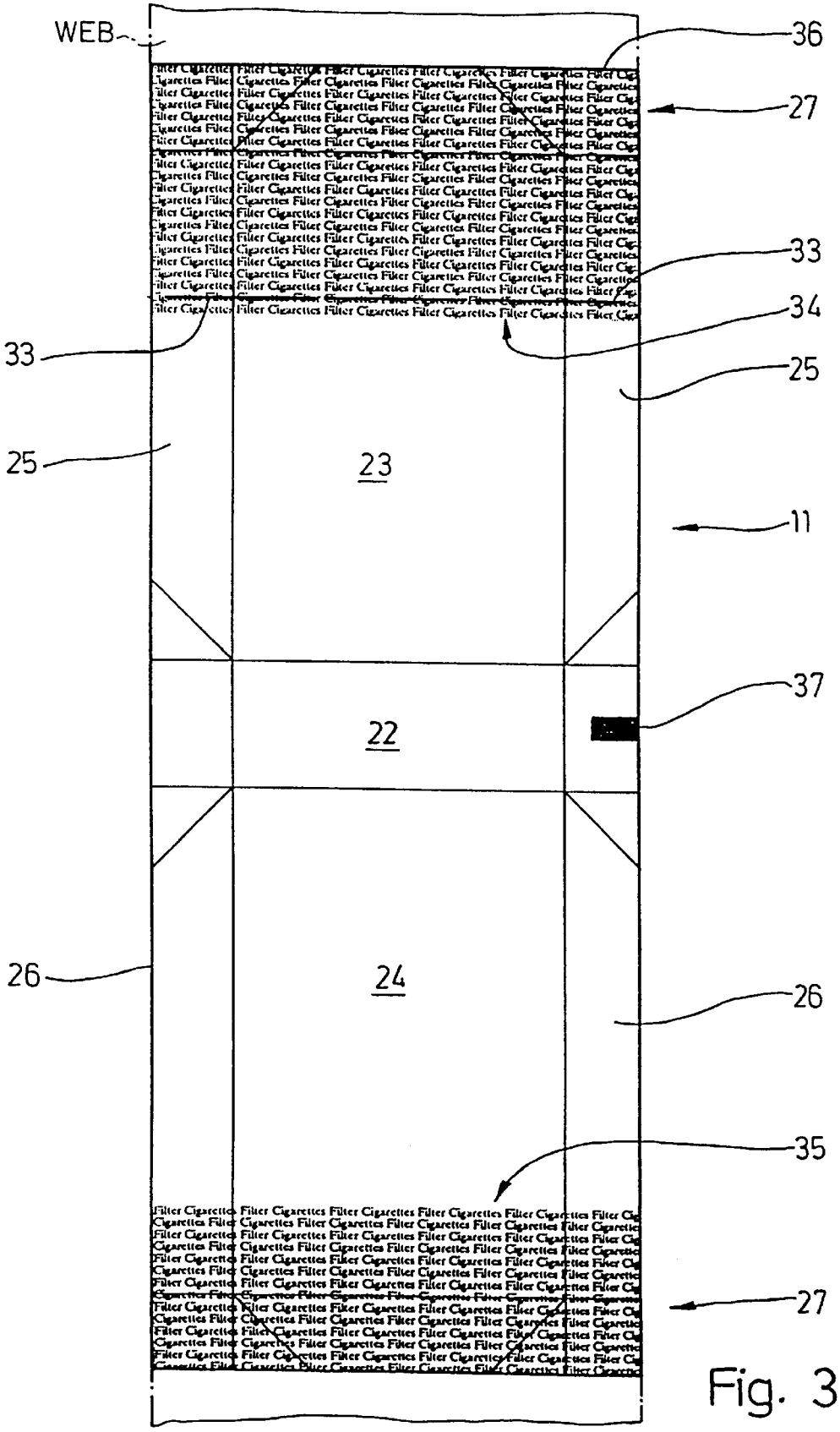
FIG. 3 shows a blank as part of a material web for an inner wrapping according to FIG. 2.

In the exemplary embodiment of FIGS. 1 to 3, the inner wrapping 11 consists of a blank which is shown spread out as part of a material web in FIG. 3. The blank is laid around the cigarette group on the sidefolding principle. A front wall 23 and a rear wall 24 adjoin a continuous closed bottom wall 22. The two narrow vertical side walls consist of side tabs 25, 26 partially overlapping one another. An upper end wall 27 is likewise formed by folding, in such a way that inner corner tabs 28, 29 and trapezoidal longitudinal tabs 30 and 31 are formed.

The front wall 23 is provided in the upper region with a pull-off flap 32, a so-called flap. According to FIGS. 1 to 3, this is defined by a perforation line 33 or another weakening line extending over the entire width of the blank (FIG. 3). When the pack is put to use, namely when it is opened for the first time, the pull-off flap 32 is detached by grasping the outer longitudinal tab 31.

The blank thus designed for the inner wrapping 11 consists of paper. The outside, that is to say the visible side of the blank, is provided with a print. In the present case, this consists of closely placed small lettering. The print is primarily intended for decorating the inner wrapping 11.

The special feature is that only part surfaces of the blank for the inner wrapping 11 are provided with a print of this kind. In the blank for the pack according to FIGS. 1 to 3, two printed zones 34 and 35 are provided. These are located at the ends of the elongate blank, namely in the region of folding tabs of the end wall 27, in the upper region of the front wall 23 and of the rear wall 24, including the side tabs 25, 26. The printed zones 34, 35 extend, here, over the entire width of the blank. In the region of the front wall 23, the printed zone 34 ends at the perforation line 33 or slightly below the latter. The printed zone 35 at the opposite end has a smaller dimension in the longitudinal direction of the blank.

The dimensions of the printed zones 34, 35 are selected so that, in the finished pack according to FIG. 1, all the surfaces of the inner wrapping 11 which are exposed when the lid 12 is opened and which can be seen from outside are printed. In view of the side edges 20 rising obliquely towards the rear wall, the printed zone 35 can be correspondingly smaller than in the region of the front wall 23. Alternatively, however, here too the printed zone 34 can end below the collar edge 18. The version illustrated is nevertheless more advantageous because the pull-off flap 32 is printed completely as a result.

In this exemplary embodiment, the blank thus designed according to FIG. 3 is severed from a material web, in which the blanks lie with their longitudinal extension in the longitudinal direction of the material web. The material web is provided with printed surfaces which are arranged at a distance from one another in the longitudinal direction of the web. The dimension of a printed surface is obtained from the sum of the dimensions of the printed zones 34 and 35 of the blank 11. Transversely directed severing cuts for dividing off the blanks 11 are positioned in such a way that, on the one hand, a larger printed zone 34 and, on the other hand, a smaller printed zone 35 of the common printing surface are separated from one another in conformity with the design of the blank 11 according to FIG. 3. Consequently, in the exemplary embodiment shown, a severing line 36 for severing the blanks 11 is located off-center in the region of the added printed surface consisting of the two printed zones 34 and 35. The exact positioning of the severing line 36 is guaranteed by printing-mark control by means of a printing mark 37.

Alternatively, in the embodiment of the blank according to FIG. 3, the material web can be designed in such a way that its width corresponds to the length of the blanks. In this embodiment (not shown) the blanks 11 are transversely directed towards the material web in their longitudinal extension. In this case, the material web is provided on both sides with continuous printed strips, especially with such having different widths.

Figure 4:
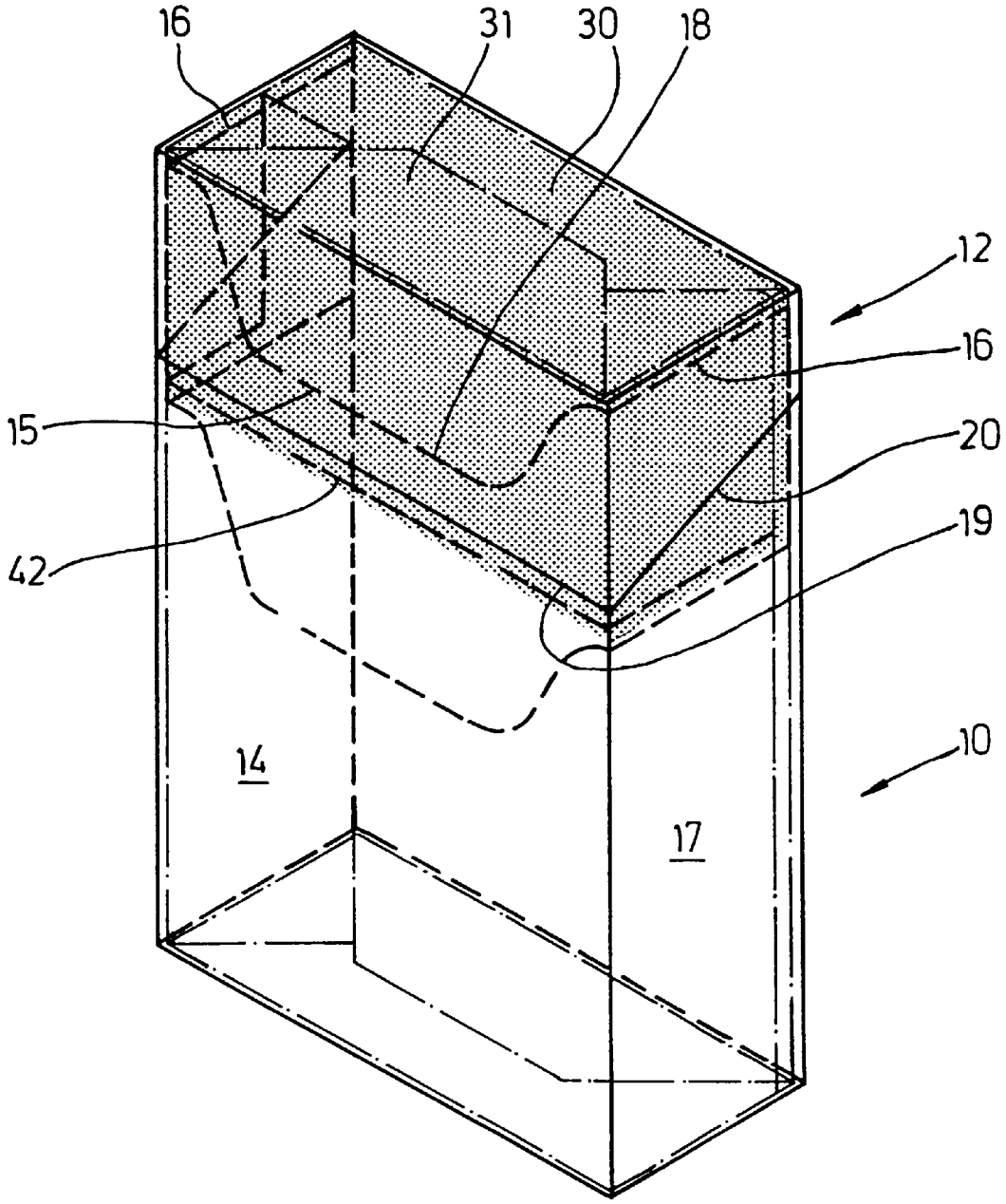
FIG. 4 shows a hinge-lid pack having a different design of an inner wrapping, in a perspective representation.
Figure 5:
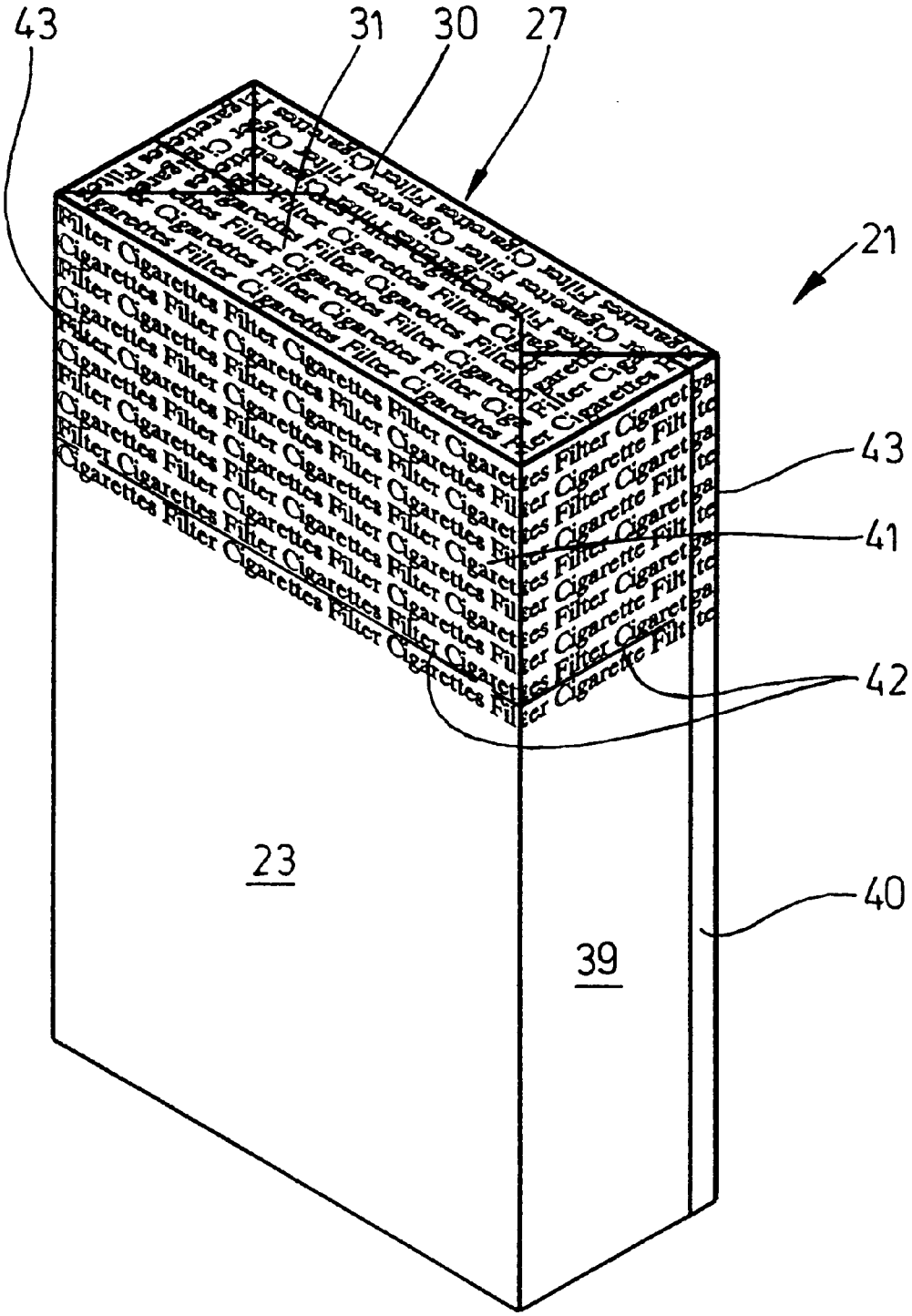
FIG. 5 shows a cigarette block for the hinge-lid pack according to FIG. 4 in a perspective representation.
Figure 6:
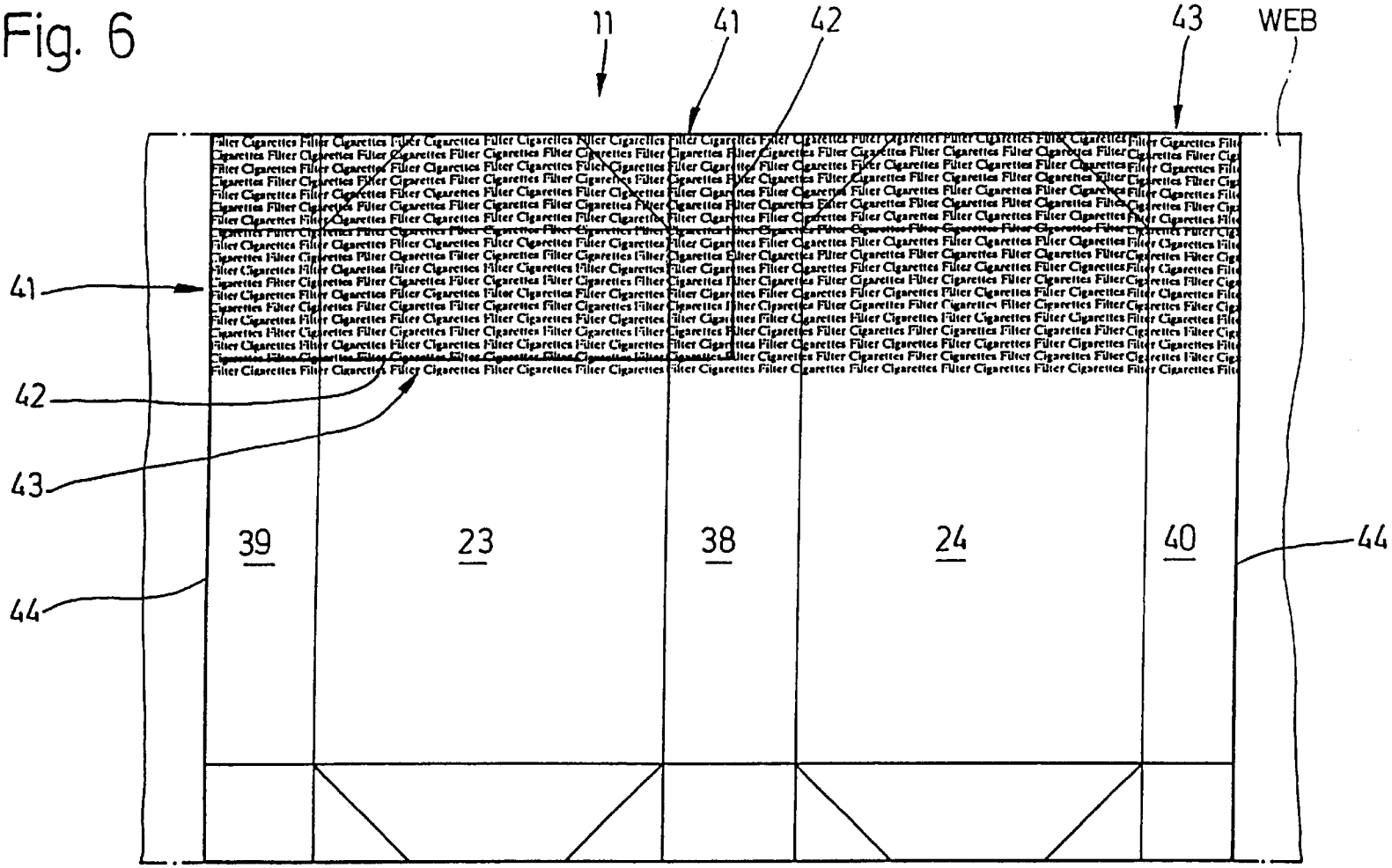
FIG. 6 shows a cut-out from a material web with blanks for an inner wrapping relating to FIG. 5.

FIGS. 4 to 6 show exemplary embodiments of a hinge-lid pack, in which only the inner wrapping 11 differs from the exemplary embodiment according to FIGS. 1 to 3. In particular, here, this is designed on the bottom-folding principle. In the blank according to FIG. 6 for the inner wrapping 11, a front wall 23, a closed side wall 38 and a rear wall 24 are arranged next to one another. A second side wall of the inner wrapping 11 is formed by side tabs 39 and 40. These partially overlap one another (FIG. 5). An end wall 27 is designed in the way already described.

The blank is also provided with a pull-off flap 41. This is limited by an angular perforation line 42 which extends with a vertical leg approximately in the middle of the side wall 38 as far as the upper free edge of the blank. A horizontal leg of the perforation line 42 runs as far as the side tab 39 or as far as the free edge of the blank. A bottom wall of the inner wrapping is designed in a similar way to the end wall 27, that is to say with folding tabs designed in the same way.

In this design of the blank for the inner wrapping 11, a strip-shaped printed zone 43 is formed on an upper edge region of the blank. A head region of the cigarette block 21 is thereby printed all-round in continuous width or height, namely, here, to directly below the perforation line 42 or the horizontal leg of the latter.

The width of the printed zone 43 is dimensioned so that, within the hinge-lid pack (FIG. 4), all the outer surfaces of the inner wrapping 11 which are visible when the lid 12 is opened are printed.

A material web for the production of the blanks (FIG. 6) is provided, here, with a continuous printed strip made at the edge. The making of transversely directed severing lines 44 requires no exact control here, since the severing cut cannot influence the effective width or height of the printed zone 43.

Figure 8:
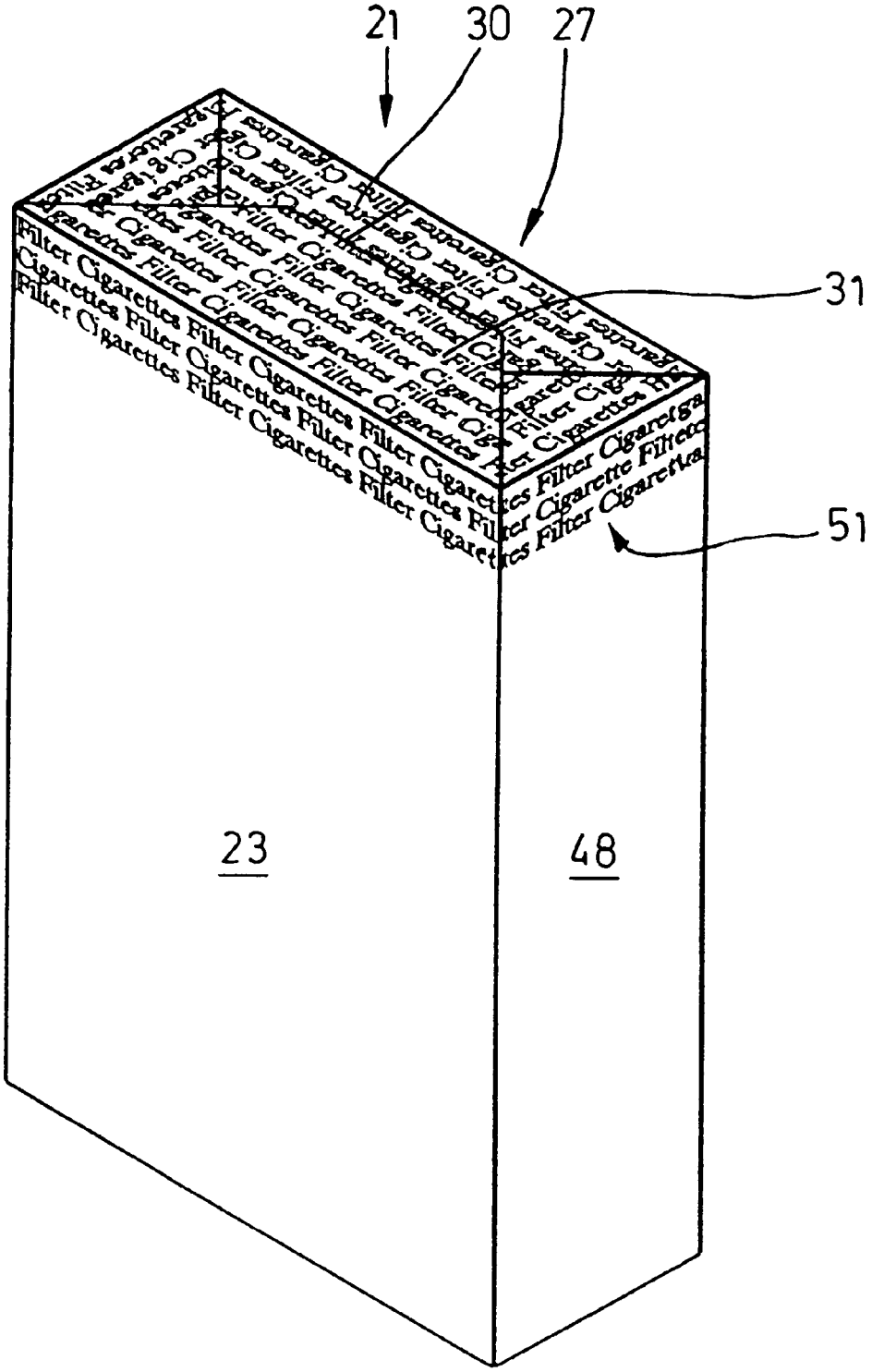
FIG. 8 shows a cigarette block with an inner wrapping for a cigarette pack according to FIG. 7.
Figure 9:
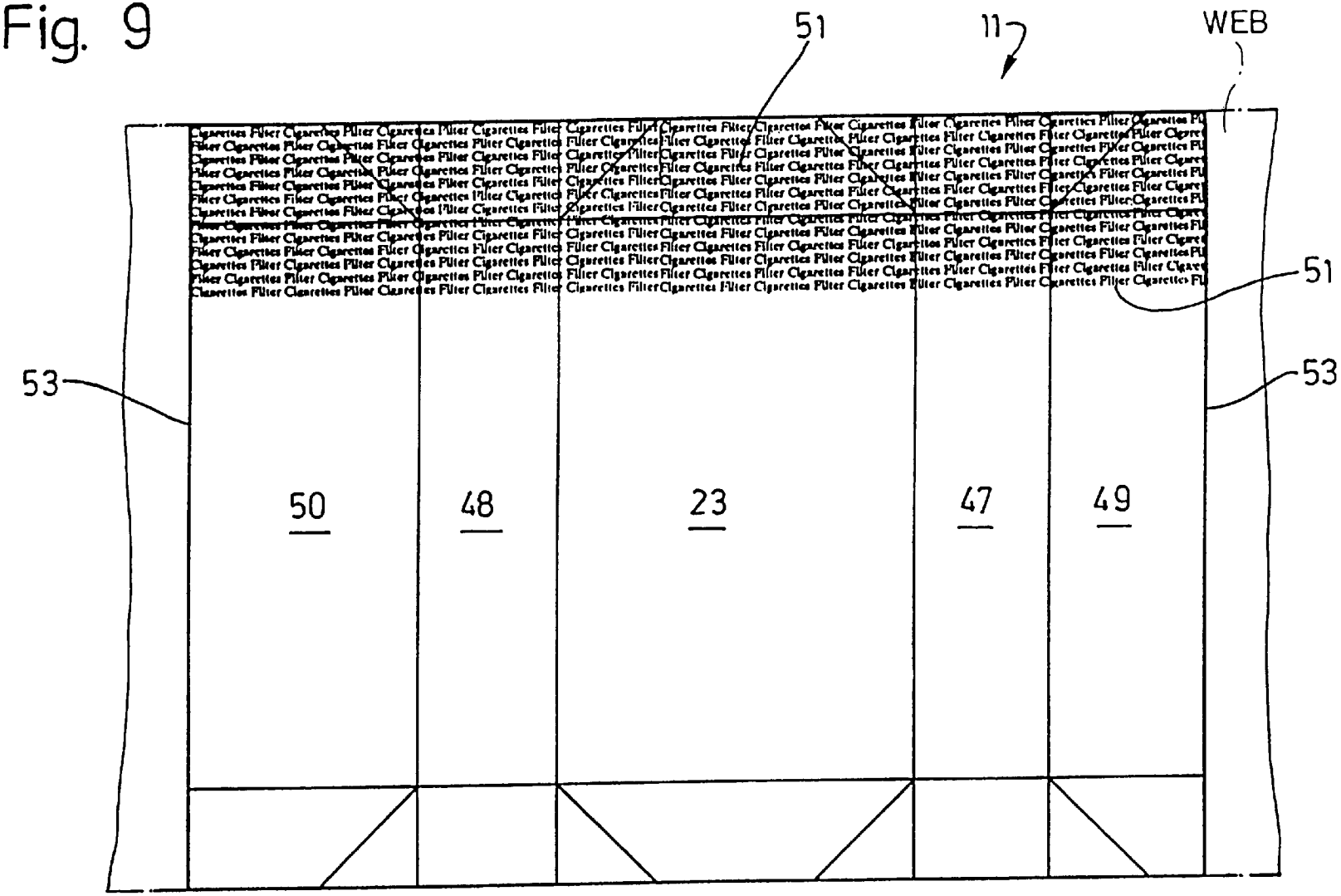
FIG. 9 shows a portion of a material web with a blank for a cigarette pack according to FIG. 7 and 8.

FIGS. 7 to 9 show the design of a soft-cup pack. This consists of an (outer) cup 45, usually made from paper. The cup 45 is open at the top. A lower bottom wall is formed by the folding of tabs. The cigarette block 21 projects slightly out of the cup 45 at the top. A band 46 conventionally extends over the upper end wall 27 of the cigarette block 21.

The blank for the inner wrapping 11 of this pack is designed in a similar way to the above-described exemplary embodiment according to FIGS. 4 to 6. However, a closed front wall 23 is present. Likewise closed side walls 47 and 48 adjoin this. In this case, a rear wall is formed by two rear-wall tabs 49 and 50 partially overlapping one another. The overlap lies approximately in the middle region of the rear wall.

A pull-off flap is not customary in this type of pack. Instead, in order to open the cup packs a region of the end wall 27 is opened by tearing off folding tabs.

The blank (FIG. 9) is provided at one edge with a continuous strip-shaped printed zone 51. This extends over the entire length of the blank or of a material web for the production of the blanks. The width or height of the printed zone 51 is selected so that, in the finished pack (FIG. 7), the part of the inner wrapping 11 projecting out of the cup 45 is printed completely. A lower edge of the printed zone 51 therefore extends below a cup edge 52 running all-round. Since all the folding tabs of the end wall 27 are also printed, this gives the impression, even when the pack is opened, that the blank for the inner wrapping is printed completely as a whole.

Here too, there is no need for any printing marks in order to control severing cuts along severing lines 53 transverse to the strip-shaped printed zone 51.

As is customary, the packs designed in the way described can be provided with an outer wrapping made from foil or cellulose film.

What is claimed is:

1. An elongated continuous cigarette pack inner liner paper web having a plurality of elongated blanks for inner liners (11) that accommodate a cigarette group as the contents of a cigarette pack, each liner blank (11) having a closed bottom wall portion (22), and wherein:

a) the elongated web comprises said elongated blanks extending with their longitudinal dimension in the longitudinal direction of the elongated web in such a way that the width of the elongated web corresponds to the width of the blanks;

b) the web contains transversely directed severing lines (36) along which the blanks are severable from the web;

c) the elongated web has printed surface areas which are spaced at a distance from one another in the longitudinal direction of the web, and which correspond in size to the sum of respective printed zones (34,35) of two successive blanks in the web;

d) the printed surface areas contain full-surface decorative printing;

e) each severing line (36) for severing successive blanks from the web runs within the printed surface areas in such a way that the blanks, after being severed, have printed zones (34) on opposite ends thereof; and f) the printed zones (34,35) have a width greater than either: the inner liner area exposed in an open hinge-lid cigarette pack or the inner liner area projecting out of a soft-cup cigarette pack.

2. The web according to claim 1, wherein each severing line (36) in the web, for severing successive blanks from the web, is guided off-center within the printed surface areas so that the printed zones (34,35) of severed blanks have different widths at their opposite ends, with a wider printed zone (34) encompassing a pull-off flap portion (32) which is defined by transverse perforation lines (33).

3. An elongated continuous cigarette pack inner liner paper web having a plurality of elongated blanks for inner liners (11) that accommodate a cigarette group as the contents of a cigarette pack, each blank having a pack end wall portion (27), formed by folding tabs, and a pack bottom wall portion also formed by folding tabs, and wherein:

a) the elongated web contains transversely directed severing cuts along which successive blanks are severable from the web;

b) the elongated web has a width that corresponds to the length of the elongated blanks to be produced, wherein a material strip for forming folding tabs for the pack end wall (27), and a material strip for forming folding tabs for the bottom wall, extend along lateral edge regions in the longitudinal direction of the elongated web, and the lateral edge regions are spaced from each other;

c) there is formed at only one edge region of the web, in a region of the material strip for forming said folding tabs for the end wall (27), a continuous, strip-shaped printed zone having a width that is substantially greater than the width of the material strip for said folding tabs of the end wall (27), so that, for a blank for an inner liner (11) of a soft-cup cigarette pack, the visible part of the inner liner (11), projecting out of the cup, is completely printed; and d) the strip-shaped printed zone is provided with full-surface decorative printing.

4. An elongated continuous cigarette pack inner liner paper web having a plurality of elongated blanks for inner liners (11) that accommodate a cigarette group as the contents of a cigarette pack, each of the blanks for the inner liner (11) having a pack end wall (27) portion, formed by folding tabs, and a pack bottom wall portion also formed by folding tabs, and wherein:

a) the blanks for the inner liner are severable from the elongated web by transversely directed severing cuts in the elongated web;

b) the elongated web has a width that corresponds to the length of the elongated blanks to be produced, wherein a material strip for forming folding tabs for the pack end wall (27), and a material strip for forming folding tabs for the bottom wall, extend along lateral edge regions in the longitudinal direction of the elongated web, and the lateral edge regions are spaced from each other;

c) there is formed at one edge region of the web, in a region of the material strip for forming the folding tabs for the end wall (27), a continuous, strip-shaped printed zone having a width that is substantially greater than the width of the material strip for said folding tabs of the end wall (27), so that a region of an inner liner (11), which projects out of a hinge-lid cigarette pack, is completely covered with printing; and d) the strip-shaped printing zone is provided with full-surface decorative printing.

5. The web according to claim 4, wherein the strip-shaped printed zone has a width that is greater than the width of a pull-off flap, of a hinge-lid cigarette pack, formed at an edge of the web by means of perforation lines (42).

* * * * *